United States Patent [19]

Ptaszek et al.

[11] 4,257,610

[45] Mar. 24, 1981

[54] SNAPPING ANIMAL GAME

[76] Inventors: George W. Ptaszek, Elm St., P.O. Box 260, Pascoag, R.I. 02859; Robert H. Hudson, 103 Valley St., Seekonk, Mass. 02771

[21] Appl. No.: 37,856

[22] Filed: May 10, 1979

[51] Int. Cl.[3] ..... A63F 3/00; A63F 9/00

[52] U.S. Cl. ..... 273/248; 273/284; 273/286; 273/287; 273/1 R; 46/141

[58] Field of Search ..... 273/287, 286, 281, 284, 273/1 G, 1 GA, 248; 46/141

[56] References Cited

U.S. PATENT DOCUMENTS

| | | | |
|---|---|---|---|
| 1,127,594 | 2/1915 | Cooper | 273/286 X |
| 4,068,401 | 1/1978 | Saitoh | 46/92 |
| 4,132,412 | 1/1979 | Birdsall | 273/251 |

FOREIGN PATENT DOCUMENTS

| | | | |
|---|---|---|---|
| 329321 | 10/1903 | France | 273/286 |
| 309593 | 9/1955 | Switzerland | 273/286 |

*Primary Examiner*—Richard T. Stouffer
*Assistant Examiner*—Scott L. Brown

[57] ABSTRACT

A game is provided in which individual playing pieces are moved incrementally along an elongated rectangular game board, according to the random throw of a die. The game board in the form and position of an elongated movable strip and is mechanically self-retracted continuously into a fixed body in the form of an animal's head, the mouth portion of which continually opens and closes during the play of the game. The playing pieces are moved incrementally away from the animal's snapping mouth according to the random throw of the die, the object of the game being for a playing piece to reach the safe area at the extremity of the elongated strip prior to full retraction of the strip, along with the playing piece into the animal's opening and closing mouth.

4 Claims, 4 Drawing Figures

SNAPPING ANIMAL GAME

BACKGROUND OF THE INVENTION

The subject invention relates to games, and more particularly to a game employing a two-dimensional moving game board in conjunction with a three-dimensional animated object. In a preferred form, the subject game simulates an attempt of moving mice to elude the opening and closing jaws of a cat, while the mice are moving along an elongated game board, simulated as a retractable tongue of the cat.

Prior art games are well known in which objects are advanced on a two-dimensional game board in accordance with the random throw of a die or a pair of dice. However, none of these games have simulated a moving mouse attempting to elude the opening and closing jaws of a cat, by moving along the cat's tongue to a safe region. Neither have they involved the simultaneous mechanical retraction of a movable strip along with the opening and closing of an opening in a fixed body or more specifically the retraction of a cat's tongue into a facsimile of a cat's head.

SUMMARY OF THE INVENTION

It is, therefore, an object of the present invention to provide a game in which playing pieces on a movable strip may avoid being deposited in a fixed body.

More specifically in its preferred form, it is an object to provide a game simulating an attempt of a mouse to elude a pursuing cat.

It is an additional object of the invention to provide such a game on a programmed, self-moving two-dimensional game board.

These and other objects of the invention are obtained by using a retractable two-dimensional game board in the form of a cat's tongue.

Players move individual facsimile mice from point-to-point on the retractable two-dimensional game board by means of the throw of a die. The opening and closing of the cat's mouth occurs during the simultaneous retraction of the two-dimensional elongated game board which serves as the cat's tongue. The arrival of a player's mouse at a designated safe area at the extremity of the cat's tongue, following the movement of the mouse in response to the random throw of a die, results in the player so doing becoming the winner of the game.

BRIEF DESCRIPTION OF THE DRAWINGS

The preferred embodiment and best mode contemplated for practicing the just-described invention will now be described in detail in conjunction with the drawings, of which.

DESCRIPTION OF THE PREFERRED EMBODIMENT

Figure 1:
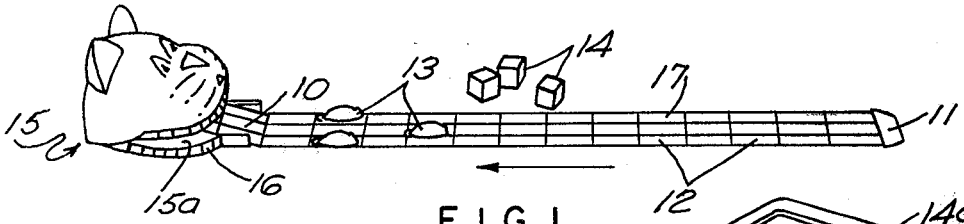
FIG. 1 is a raised side view of the game board, the facsimile cat's head, the facsimile mice, and the dice of the preferred embodiment of the invention.

The game board 17 along with the fixed body in the form of a facsimile cat's head 15, the playing pieces or facsimile mice 13, and the playing die 14 of the preferred embodiment of the invention are illustrated in FIG. 1. The pathways along which the mice are incrementally advanced on the game board 17 proceeds from the exit of the movable opening in the form of a cat's mouth 15*a*, at point 10, along a plurality of discrete spaces 12 and terminates at the outermost safe region 11.

The two-dimensional rectangular elongated game board 17 simulates a cat's tongue, and continuously self-retracts within the continually snapping cat's mouth 15*a* during the course of the game. The mouse facsimile tokens 13 are seen occupying typical playing spaces 12 during the course of the game. As each player in turn throws a die 14, the number randomly displayed on the uppermost surface 14*a* of the playing die 14 represents the number of spaces that the mouse facsimile 13 is to be moved incrementally away from the cat's mouth 15*a* in the direction of the safe region 11. As the game proceeds, the tongue-shaped elongated game board 17 continually self-retracts in the direction as indicated by the arrow shown in FIG. 1. The first player whose mouse facsimile 13 reaches the space in the safe region 11, prior to complete retraction of the tongue game board 17 into the cat's mouth 15*a* is the game's winner.

Figure 2:
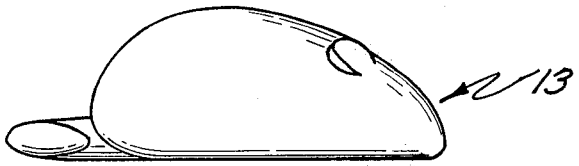
FIG. 2 is a side view of the facsimile mouse toy used in conjunction with the game board of the preferred embodiment of the invention.
Figure 3:
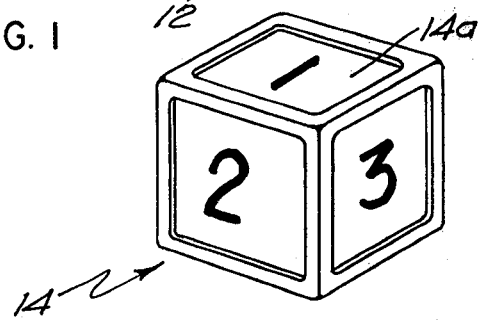
FIG. 3 is a top and side view of a die used in conjunction with the game board of the preferred embodiment of the invention.

The facsimile mouse and the playing die, that are used in conjunction with the game board of the preferred embodiment of the invention, are shown in FIGS. 2 and 3 respectively, the playing die 14 here being the means for randomly determining the amount of incremental advance of the facsimile mice 13 playing pieces along the playing paths of said game board 17.

Figure 4:
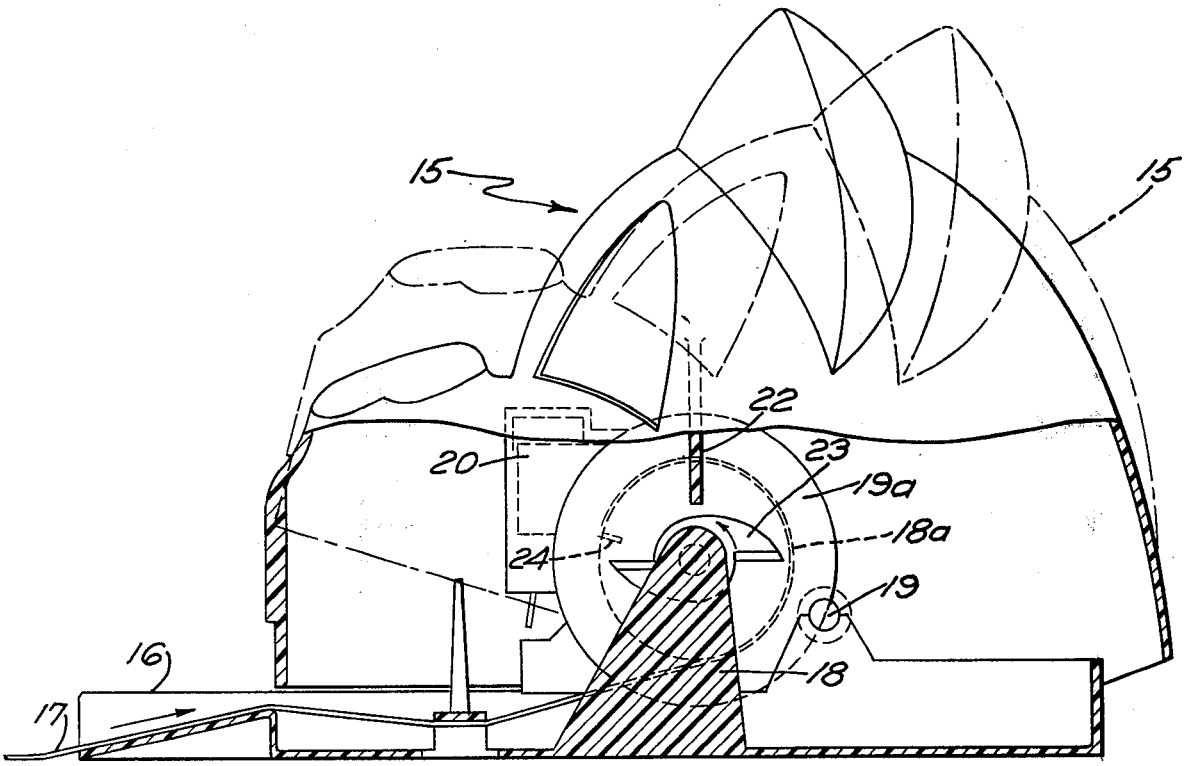
FIG. 4 is a side sectional view of the facsimile cat's head illustrating both the mouth-actuating mechanism and the retractable game board mechanism.

The repeated cycles of opening and closing of the cat's mouth 15*a* is controlled by the mouth-actuating mechanism which is also incorporated with the tongue retraction mechanism, and is illustrated in greater detail in FIG. 4.

Following the manual winding of the spring motor means 20, the start switch 19 is depressed resulting in the actuation of the rotation of a cylindrical drum 18*a* which is rotatably mounted in a horizontal position on base 16. Base 16 forms the fixed lower portion of the cat's head 15. A rigidly attached symmetrical cam structure 18 is affixed centrally and co-planarly to the outer surface of a vertically oriented drum plate 19*a* located at one end of the cylindrical drum 18*a*. The spring-driven rotation of drum 18*a* results in the cam surface 23 contacting the cam follower 22. Cam follower 22 is an elogated integral rib extending inwardly from the inner surface of head 15 that is generally vertically oriented.

As the cam follower 22 contacts the outline of the cam surface 23, the irregular shape of the cam surface 23 leads to the opening and closing motion of the cat's mouth 15*a*. Simultaneous with the opening and closing of the cat's mouth 15*a*, the rotation of drum 18*a* causes the elongated tongue-like game board 17 to be retracted into the cat's mouth 15*a*. This retraction occurs as the game board 17 is affixed at its start end to the outer surface of the drum 18*a* in a mounting groove 24. Thus, the rotary motion of drum 18*a* results in a winding up of the flexible game board 17 contiguous to the outer curved surface of drum 18*a*.

What is claimed is:

1. A game apparatus comprising in combination:

an elongated rectangular game board for a plurality of players, a three-dimensional body, said body having a continuously movable opening, a plurality of separate three-dimensional playing pieces one for each player, said elongated rectangular playing board having a plurality of sequential spaces constituting a playing path of incremental progress to be traversed by said playing pieces, means for randomly determining the amount of incremental advance of said playing pieces along said playing path, means for continuously retracting said elongated rectangular playing board into said opening at a substantially uniform speed sufficiently slow to permit a series of manual advances of said pieces in response to said random means.

2. The apparatus of claim 1 wherein said movable game board contains a safe area at its end opposite the movable opening, said safe area to be reached by the winning player prior to full retraction of said game board into the movable opening.

3. The apparatus of claim 1 wherein the playing pieces are facsimiles of mice and being of the same shape, but of a different color, and the body is a cat's head facsimile, the opening being the cat's mouth.

4. A method of playing a game involving a facsimile animal with a defined movable mouth, a plurality of playing pieces, each under control of a respective player, and an elongated game board having a path with a plurality of spaces, said method including the steps of advancing each said playing piece under control of its respective player along said path incrementally in response to an arbitrarily determined number, retracting said game board continuously during the course of said game, opening and closing of said animal's mouth simultaneously with the retraction of said game board.

* * * * *